US006823710B1

(12) United States Patent
Rassette et al.

(10) Patent No.: US 6,823,710 B1
(45) Date of Patent: Nov. 30, 2004

(54) DIE BUTTON EXTRACTOR

(76) Inventors: Gary C. Rassette, 29070 Galloway, Roseville, MI (US) 48066; Kevin M. Lutz, 39163 Camp St., Harrison Township, MI (US) 48045

( * ) Notice: Subject to any disclaimer, the term of this patent is extended or adjusted under 35 U.S.C. 154(b) by 10 days.

(21) Appl. No.: 10/437,359

(22) Filed: May 13, 2003

(51) Int. Cl.[7] ..... B23B 27/16; B26F 1/14; B26D 7/26; B16B 2/14

(52) U.S. Cl. ..... 72/482.93; 72/482.92; 72/481.9; 72/481.1; 83/698.11; 83/690

(58) Field of Search ..... 72/481.1, 481.9, 72/482.92, 482.93; 83/686, 689.11, 690

(56) References Cited

U.S. PATENT DOCUMENTS 2,377,191 A * 5/1945 Teachout ..... 72/482.92
3,640,170 A * 2/1972 Bennett ..... 83/698.11
3,797,352 A * 3/1974 Smith ..... 83/698.11
3,848,452 A * 11/1974 Gargrave ..... 72/448
4,103,574 A * 8/1978 Greer ..... 83/698.11
4,610,185 A * 9/1986 France ..... 83/685
6,669,399 B2 * 12/2003 Janek, Jr. ..... 83/698.11
2004/0101373 A1 * 5/2004 Isaksson et al. ..... 83/698.11

* cited by examiner

*Primary Examiner*—David Jones
(74) *Attorney, Agent, or Firm*—Liell & McNeil; Jonathan F. Yates

(57) ABSTRACT

The present invention provides a die button assembly for locating a die button relative to a body die, and for facilitating removal of the die button from the body die. The assembly includes a substantially cylindrical button having a volumetrically reduced region and a complementary, internally threaded die button extractor having a foot portion extending into the volumetrically reduced region and facilitating removal of the button from the body die via an upward force applied to the internally threaded portion.

17 Claims, 1 Drawing Sheet

DIE BUTTON EXTRACTOR

TECHNICAL FIELD

The present invention relates generally to dies for stamping and punching, and to tools and processes for die button removal. More particularly, the present invention relates to a punch die button and related assembly adapted for rotationally locating the button in a body die, and for facilitating removal of the button therefrom.

BACKGROUND OF THE INVENTION

Stamping and punching processes have long been integral to manufacturing. In a manufacturing plant, there may be hundreds or even thousands of stamping and punching tools. One needs to look no further than the multitude of punched holes in an automobile body to appreciate the importance of punching and stamping operations to modem manufacturing. In a typical punching process, a punch made from a hardened steel alloy is reciprocably located above a body die or platen. A metal sheet/stock or other workpiece is passed below the punch, and the punch is actuated to move downward and pierce a "slug" from the workpiece. Depending on the purpose for punching the workpiece, various hole shapes may be desirable. For instance, where the workpiece is punched for receipt of a conventional fastener, a substantially circular hole may be appropriate. In contrast, other applications may call for a more complex shape to the hole. Different punches are commercially available, having a wide variety of shapes to the working point of the punch, accordingly forming different shaped holes in the workpiece.

The portion of the punching apparatus complementary to the punch comprises the main or lower die. When the punch is moved to a downward position, it is generally desirable to provide a shaped die portion that receives the working point and a portion of the shank of the punch, supporting the punch against lateral deflection and/or breaking as it pierces the workpiece. The prevailing approach in the industry has been to provide a "die button" that is a substantially cylindrical piece press-fit into a bore in a larger, main body die. By forming the die button with a diameter that is very slightly greater than the diameter of the bore, and pressing the button therein, the risk of the button pulling out during operation is minimized. The die button typically includes a central aperture that is shaped substantially complementary to the punch. The aperture has generally been designed to extend all the way through the button, increasing in diameter toward the bottom of the button. Thus, when the punch is lowered into the die button, it pierces a slug from the workpiece, which falls through the button, to be discarded. The press fit interface between the die button and the main body die prevents the punch from withdrawing the button from the body die when retracting.

A related problem involves the challenge of initially placing and subsequently maintaining the die button in the appropriate rotational orientation. If the button aperture is not properly aligned with the punch, excessive wear or breakage of the tools can occur. Die builders often utilize a "dowel" for locating the die button, and preventing its rotation. In a typical design, a longitudinal groove is machined into the side of the button. A complementary groove is also formed in the wall of the bore that receives the button. During assembly, the dowel is inserted into the receiving slot defined by the button and the body die. Because a portion of the dowel is situated in the button and a portion is situated in the wall of the immovable die, the button is properly positioned and prevented from rotation relative to the die.

Over the years, many improvements in punch and die durability and materials have been developed. However, those skilled in the art will appreciate the beating that punch and die tools can take over the course of thousands of hits. Even with the hardest, precision-ground tools, the parts still need relatively frequent sharpening and maintenance, and can and do wear out. Because die buttons are typically press-fit into the main body die for secure retention, a longtime challenge to tool and die shops and die maintenance departments has been the removal of die buttons from the body dies when replacement or sharpening is necessary.

Die builders have taken two general approaches for mounting die buttons in the body dies, and the design style dictates to a large extent the technique used to remove the buttons. In one design, a removable section is machined proximate the die buttons. This removable section or retainer is removed from the main body die, and the buttons are typically removed by inverting the retainer and driving them out with a hammer and metal rod or with an arbor press. In designs wherein the button is not installed in a removable retainer, such as a large die post (which may be a large cast section the size of an automobile), the entire body die must be lifted by an overhead crane, inverted and the buttons forced out of the body die with a hammer, press, etc. In either system, substantial man-hours may be required to replace or sharpen a few die buttons. The punch is not usable during this process, and production is therefore obviously impossible. Various other techniques have been used to remove die buttons, however, most if not all take a considerable amount of time and effort. Moreover, these relatively inelegant techniques risk damage to the die button and the die sections themselves. Overall, maintenance associated with punch die buttons has heretofore been a woefully inefficient endeavor.

The present invention is directed to one or more of the shortcomings or limitations set forth above.

SUMMARY OF THE INVENTION

It is an object of the present invention to provide a simple and cost-efficient means for removing punching or stamping die buttons from a body die.

It is a further object of the present invention to provide a die button assembly that includes means for rotationally locating the die button relative to a body die, and for facilitating removal therefrom.

In accordance with the foregoing and other objects, the present invention provides an improved die button assembly that includes a die button having a longitudinal groove and a volumetrically reduced region. The die button assembly further includes a puller member comprising an internally threaded dowel and an integral foot portion adapted to extend under the die button for extraction thereof.

DETAILED DESCRIPTION

The present invention provides a die button and related assembly for use with an industrial punch and die apparatus.

Figure 1:
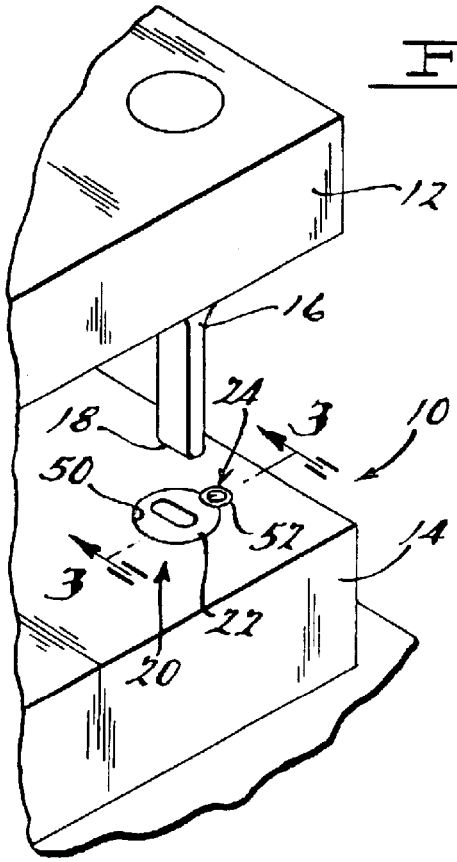
FIG. 1 is a perspective view of a punch and die button assembly according to the present invention.

Referring to FIG. 1, there is shown a perspective view of a punch assembly 10 in accordance with a preferred constructed embodiment of the present invention. Assembly 10 includes an upper die shoe 12 and a lower die shoe or body die 14. A reciprocable punch 16 is retained with upper die shoe 12 in a conventional manner, and is operable to pierce a workpiece (not shown in FIG. 1) that is passed underneath the punch 16 in a manner well known in the art. A die button assembly 20 is located in lower die shoe 14, and receives the working point 18 of punch 16. Die button assembly 20 includes a button 22 and a puller member 24. In one preferred embodiment, die button assembly 20 is press fit into a bore(s) in body die 14, however, those skilled in the art will appreciate that the present invention will find application to other designs wherein different styles of mounting/retaining the buttons within the body die or associated retainer are used. For example, other embodiments (not shown) could utilize a separate button retainer mounted within or on top of body die 14 rather than the illustrated design. Moreover, it should be appreciated that the particular punch/button design illustrated in FIG. 1 is not limiting, and the variety of punches or buttons that might be used in conjunction with the present invention is much broader. All the components of the present invention are made from known materials, and are manufactured by known processes. As is well known in the art, it is generally desirable to make the various punches, buttons, pullers, etc, described herein from a steel or iron alloy, which is preferably heat treated or otherwise processed to enhance its hardness and durability.

Figure 2:
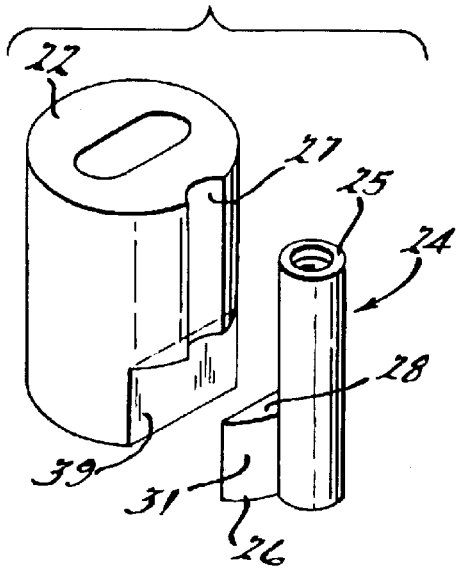
FIG. 2 is an exploded view of a die button and die button extractor tool according to the present invention.
Figure 3:
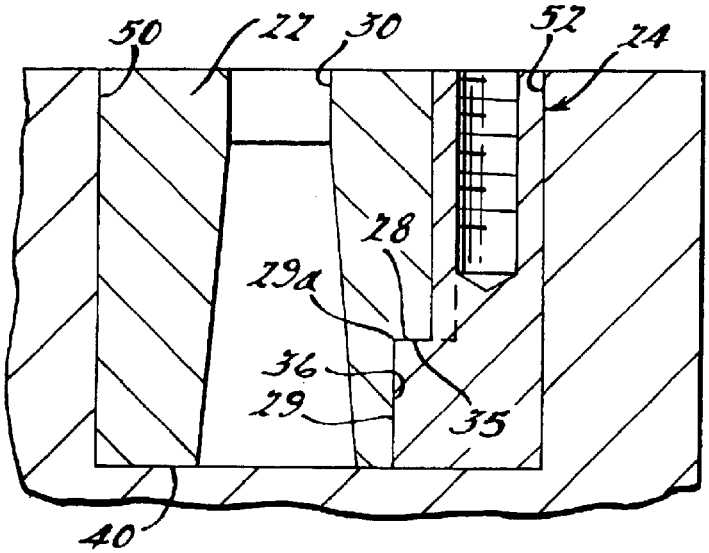
FIG. 3 is a sectioned side view of a die button and die button extractor tool according to the present invention.

Turning also to FIGS. 2 and 3, there are shown exploded and sectioned views, respectively of die button assemblies according to the present invention. In particular, FIG. 3 is a partial sectioned view of the apparatus pictured in FIG. 1, taken along line A-A. As illustrated in the drawing Figures, die button 22 preferably includes a central bore 30. In a preferred embodiment, the diameter of central bore 30 increases toward a bottom end 40 of button 22. Thus, when a punch such as punch 16 in FIG. 1 pierces a piece of stock in the apparatus, the increasing diameter of bore 30 allows the material slug created by punch 16 to readily fall out of the button. Various backing plugs or similar items (not shown in FIG. 3) may be positioned underneath button 22, however, illustration has been omitted from FIG. 3 for clarity.

FIGS. 2 and 3 also illustrate puller member 24. Puller member 24 serves the dual purposes of rotationally positioning button 22 and facilitating its extraction from the body die 14. Puller 24 includes an internally threaded dowel 25 that is integral with a foot 26. Dowel 25 is preferably substantially cylindrical, and can be threaded either right-handed or left-handed. As used herein, the term "integral" should be understood to mean that the dowel and foot are connected as a single piece. This includes designs wherein separate dowel and foot pieces are joined, as well as designs in which the dowel and foot are originally formed as a single member. Multiple piece embodiments (not shown), while contemplated, are not preferred. In a preferred embodiment, dowel 25 is substantially complementary with a longitudinal (vertical) cutout 27 defined by button 22. This cutout 27 is preferably substantially arcuate in cross section, preferably approximately defining a portion of a circle. Returning to FIG. 1, there is illustrated the engaged dowel 25 and button 22. Button 22 is preferably substantially right circular, and is press fit into a cylindrical bore 50 in body die 14. A second, partially circular bore or groove 52 is formed in the wall of bore 50. Button 22 is preferably positioned in bore 50 such that its cutout 27 is aligned with groove 52, each of cutout 27 and groove 52 defining a portion of a cylinder that receives dowel 25. Thus, when dowel 25 is engaged in groove 27, and button 22 and dowel 25 are fit within their respective bores in body die 14, button 22 is prevented from rotating relative to body die 14 via its interface with dowel 25. Stated another way, when engaged, puller 24 and button 22 define a non-circular horizontal cross section that cannot rotate relative to body die 14.

Foot 26 extends outwardly from dowel 25, and preferably includes a substantially planar top face 28 that defines a plane oriented preferably substantially perpendicular to the orientation of dowel 25. Foot 26 also preferably includes a planar inner face 29 oriented substantially perpendicular to top face 28. It is preferred to grind or otherwise slightly reduce the upper edge (represented by dashed line 29*a* in FIG. 2) of side face 29, such that the transition from side face 29 is less abrupt than it would be with an unmodified edge. The outer face(s) 31 of foot 26 are preferably substantially arcuate. The thickness of foot 26 (as measured vertically, i.e. longitudinally of dowel 25) is preferably from about $1/5^{th}$ to about $3/5^{th}$s, most preferably about $2/5^{th}$s, the total vertical height of puller member 24. In one preferred embodiment, the various features of foot 26 are formed by "burning" a forged template by electrical discharge machining ("EDM"). In other preferred embodiments, the entire puller member 24 is forged having substantially its final desired shape. Other methods are contemplated for shaping foot 26, and the description herein should not be taken as limiting.

Groove 27 is preferably at least partially coextensive with a volumetrically reduced region 29, which is preferably a cutout region or flat machined on button 22. As used herein, the term "volumetrically reduced" refers to the removal of a volume of material from an otherwise cylindrical member (the button). The exact shape of the volumetrically reduced region 29 is not critical, and may be varied considerably. It is merely necessary that foot 26 be able to fit within the reduced region such that it can exert an upward force on button 22 when upward force is applied to dowel 25, as described below. The preferred reduced region 29 includes two substantially planar faces oriented at approximately 90°, and positioned proximate an end 40 of button 22. In an alternative embodiment (not shown), reduced region 29 is positioned medially of the end 40, and in cross section defines a shape having one straight side and one curved side, such as would result from grinding a flat at a medial position in a cylindrical member. Puller member 24 is preferably shaped such that dowel 25 and foot 26 are substantially complementary to volumetrically reduced region 29 and groove 27, respectively, having the vertical cross section substantially as shown in FIG. 3. Other embodiments are contemplated (not shown) wherein foot 26 extends across a greater or lesser proportion of button 22 than the proportion illustrated in FIG. 3. In a preferred embodiment, button 22 defines a first radius that is greater than a second radius defined by foot 26. Stated another way, arcuate outer surfaces 31 may be thought of as forming a portion of the perimeter of a circle having a radius that is less than the radius of a circle defined by the perimeter or exterior surface of button 22. Similarly, the radius of the circle defined by a peripheral surface of dowel 25 proximate foot 26 is also preferably reduced relative to its respective bore/groove 52. Offsetting the radii makes it easier to press fit the button and puller assembly into the receiving bore. It is well known in the art to use electrical discharge machining, grinding, etching, etc. to reduce various regions of fitted parts to enhance the ease with which they are fitted together, and any of these and other, similar methods can be used to treat puller member 24 accordingly.

The buttons contemplated for use with the present invention are typically retrofitted to accommodate puller members. Typically, die buttons are substantially right cylindrical. In order to adapt commercially available die buttons for use with puller members of the present invention, the volumetrically reduced region is preferably ground from a standard die button. The button is preferably ground to include a flat oriented such that the longitudinal groove is aligned with substantially a longitudinal centerline of the flat, as shown in FIG. 2. Many commercially available buttons already have the locating groove. The dimensions of the volumetrically reduced region are variable, however, in a preferred embodiment, the region is ground to accommodate a puller member according to the present invention and it is therefore desirable to form the flat such that the foot of the puller member mates substantially therewith. Rather than modifying commercially available buttons, however, die buttons could be manufactured according to the present invention by originally producing buttons with the desired shape.

When a die button becomes too worn to be of use and must be replaced or sharpened, or a new type of button is to be switched for the old ones, the present invention allows the buttons to be removed easily. Removal of a worn die button begins by screwing a threaded tool into threaded dowel 25. Once engaged therein, any of a variety of means can then be used for applying upward force to the dowel. For example, an apparatus similar to a dent puller for use with automobiles (for example a slide hammer) can be positioned on the body die, and then cranked to draw the threaded dowel upward. Such tools and apparatuses are well known. As the dowel is drawn upward, foot 26 engages the underside of button 22 (i.e. the horizontal face bounding reduced region 29), pulling the button upward and eventually freeing button 22 from its bore. A replacement button can then be pressed into the bore along with the same or a similar puller 24. Alternatives are contemplated wherein, for example, a motorized removal assembly is used to draw puller member 24 and button 22 upwardly and out of their bores.

The present invention offers a substantial advantage over many prior methods of removing die buttons. Not only is the process much faster, it does not require the use of heavy equipment, obviating safety and energy consumption concerns associated with the use of overhead cranes, presses, etc. previously used for removing die buttons. Further still, because it is unnecessary to use the relatively large forces required to remove buttons in previous methods, the present invention allows die buttons to be removed with reduced risk of damaging the buttons or supporting dies. The present invention is for illustrative purposes only, and should not be construed to limit the scope of the present invention in any way. Thus, those skilled in the art will appreciate that various modifications might be made to the presently disclosed embodiments without departing from the full and fair scope of the appended claims, and intended spirit of the invention. For example, rather than the described, relatively small extension of the foot under the die button, the puller member foot could extend under the entire die button. Similarly, rather than positioning the volumetrically reduced region for receipt of the foot at the end of the button, the region could be positioned medially at a point along the vertical length of the button, and the foot inserted therein. Further still, the shape of the volumetrically reduced region need not be a flat, as described. Alternatively, the reduced region might be wedge-shaped or of some other design such as a radial reduction having a rounded inner surface rather than a flat. Other aspects, features and advantages will be apparent upon an examination of the attached drawing Figures and appended claims.

What is claimed is:

1. A puller member for removing a die button having a bearing surface from a body die comprising:

a substantially cylindrical dowel having threads for engaging with a removal tool, an orientation of said dowel defining a vertical axis; and a foot integral with said dowel and extending outwardly therefrom, said foot having a substantially planar top face wherein said foot is adapted to engage with a die button, whereby an axial force on said dowel can bear said face against said bearing surface to transmit the force to said die button and extract the same from the body die.

2. The puller member of claim 1 wherein said foot comprises an inner face oriented substantially perpendicular to said top face, and a plurality of arcuate outer faces.

3. The puller member of claim 2 wherein a vertical thickness of said foot is in the range of about $1/5^{th}$ to about $3/5^{th}$ the vertical height of said puller member.

4. The puller member of claim 3 wherein a vertical thickness of said foot is about $2/5^{th}$ a vertical height of the puller member.

5. The puller member of claim 1 wherein said foot has a substantially circular horizontal cross section.

6. The puller member of claim 1 wherein said foot has a partially circular horizontal cross section.

7. A button assembly for a metal stamping apparatus having a reciprocable punch and a punch die, the button assembly comprising:

a substantially right cylindrical button having a locating groove and a substantially planar surface spaced axially from ends of the die button, said surface oriented transverse said groove; and a puller member engageable with said button and comprising a foot adapted to bear against said planar surface, and a threaded dowel complementary with said groove;

wherein upward force on said dowel applies an upward force on said button via said foot, thereby facilitating extraction of said button from a body die.

8. The button assembly of claim 7 wherein said foot includes a substantially planar top face and an inner face perpendicular to said top face, said foot further including arcuate outer faces.

9. The button assembly of claim 8 wherein an exterior surface of said button defines a first radius, and wherein said foot defines a second radius that is smaller than said first radius.

10. The button assembly of claim 7 wherein said button and said puller member define a shape having a non-circular cross section when engaged.

11. A die button assembly for an industrial punch comprising:

a substantially right cylindrical button member having a volumetrically reduced region and a longitudinal groove;

a puller member matable with said button member, thereby defining a non-cylindrical shape, said puller member having a threaded dowel substantially complementary with said longitudinal groove, and an integral foot;

wherein mating of said puller member with said button member positions said foot in said volumetrically reduced region and said dowel in said groove.

12. The die button assembly of claim 11 wherein said volumetrically reduced region is a flat positioned proximate an end of said button member.

13. The die button assembly of claim 11 wherein said volumetrically reduced region defines a cross sectional shape having one straight edge and one arcuate edge, and wherein said region is located medially in said die button.

14. The die button assembly of claim 11 wherein said foot comprises a substantially planar top face and a substantially planar inner face perpendicular to said top face.

15. The die button assembly of claim 14 wherein said foot has a reduced edge at an interface of said side face with said top face.

16. The die button assembly of claim 11 wherein said volumetrically reduced region includes two substantially perpendicular planar faces.

17. The die button assembly of claim 13 wherein said volumetrically reduced region is positioned medially in said button.

* * * * *